US008723681B2

(12) United States Patent
Farley et al.

(10) Patent No.: US 8,723,681 B2
(45) Date of Patent: May 13, 2014

(54) APPARATUS AND METHODS FOR PROVIDING EMERGENCY OVERRIDE OF INFORMATIONAL DISPLAYS

(75) Inventors: Daniel G. Farley, Westminster, MA (US); Matthew Farley, Gardner, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 691 days.

(21) Appl. No.: 12/944,801

(22) Filed: Nov. 12, 2010

(65) Prior Publication Data

US 2012/0119921 A1 May 17, 2012

(51) Int. Cl.
*G08B 21/00* (2006.01)
*G08B 3/00* (2006.01)

(52) U.S. Cl.
USPC ..... 340/691.6; 340/691.1; 340/7.59; 40/453

(58) Field of Classification Search
USPC ..... 340/691.6, 286.01, 541, 577, 7.1, 7.2, 340/7.46, 7.48, 7.51, 7.53, 7.54, 7.55, 7.56, 340/7.57, 7.58, 7.59, 7.61, 7.62, 311.2, 928, 340/98, 908.1, 906, 905, 691.1, 500, 332, 340/331; 709/206; 40/446, 453; 345/1.1
See application file for complete search history.

(56) References Cited

U.S. PATENT DOCUMENTS

| | | | | |
|---|---|---|---|---|
| 3,975,583 | A * | 8/1976 | Meadows | 348/460 |
| 7,232,517 | B1 * | 6/2007 | Shepherd | 210/94 |
| 7,259,666 | B1 * | 8/2007 | Hermsmeyer et al. | 340/517 |
| 7,889,092 | B2 * | 2/2011 | Volk et al. | 340/691.5 |
| 2004/0104808 | A1 * | 6/2004 | Khoshbin | 340/7.5 |
| 2006/0119535 | A1 * | 6/2006 | Van Fossan | 345/1.1 |
| 2009/0144156 | A1 * | 6/2009 | Girgis et al. | 705/14 |

* cited by examiner

*Primary Examiner* — Anh V La
(74) *Attorney, Agent, or Firm* — Kacvinsky Daisak PLLC

(57) ABSTRACT

Various embodiments are generally directed to a system and method for providing emergency override of informational displays in an emergency notification system. An embodiment may include an emergency detection module coupled to a display override module. The display override module may be coupled to a third-party display driver. When an emergency condition is detected, the emergency detection module may use the display override module to override any display messages from the third-party display module in order to display an emergency display message. In an embodiment, the display override module may be a switch box. In another embodiment, the display override module may be a RSS feed subscribed to by the third-party display driver. Other embodiments are described and claimed.

21 Claims, 5 Drawing Sheets

APPARATUS AND METHODS FOR PROVIDING EMERGENCY OVERRIDE OF INFORMATIONAL DISPLAYS

BACKGROUND

1. Field of the Invention

Embodiments of the disclosure relate to the field of emergency communication systems. More particularly, the present disclosure relates to a system and method for providing emergency override of informational displays in an emergency notification system.

2. Discussion of Related Art

Fire and emergency communication systems may alert occupants of a building to emergency conditions. Increasingly, such systems have the capability to provide additional information, beyond merely sounding an alarm, about the emergency situation and/or to instruct the building occupants how to respond to the emergency. Some buildings, such as office buildings, apartments buildings, office parks and educational campuses have electronic signs that convey information to the residents or occupants about non-emergency points of interest. Installing displays specifically for the use of the fire/emergency monitoring system may be expensive or redundant. Accordingly, there may be a need for an improved apparatus and method to allow a fire and emergency communication system to make use of existing displays.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Various embodiments are generally directed to a system and method for providing emergency override of informational displays. An embodiment may include an emergency detection module coupled to a display override module. The display override module may be coupled to a third-party display driver. When an emergency condition is detected, the emergency detection module may use the display override module to override any displayed messages from the third-party display module in order to display an emergency display message. In an embodiment, the display override module may be a switch box. In another embodiment, the display override module may be a RSS feed subscribed to by the third-party display driver. Other embodiments are described and claimed.

These and other features and advantages will be apparent from a reading of the following detailed description and a review of the associated drawings. It is to be understood that both the foregoing general description and the following detailed description are explanatory only and are not restrictive of aspects as claimed.

DESCRIPTION OF EMBODIMENTS

Various embodiments are directed to overriding previously installed or 3$^{rd}$ party display systems with emergency messaging when an emergency is detected. In one or more embodiments, an emergency detection system may override a third-party display driver in order to display an emergency message on one or more displays normally driven by the third-party display driver.

Figure 1:
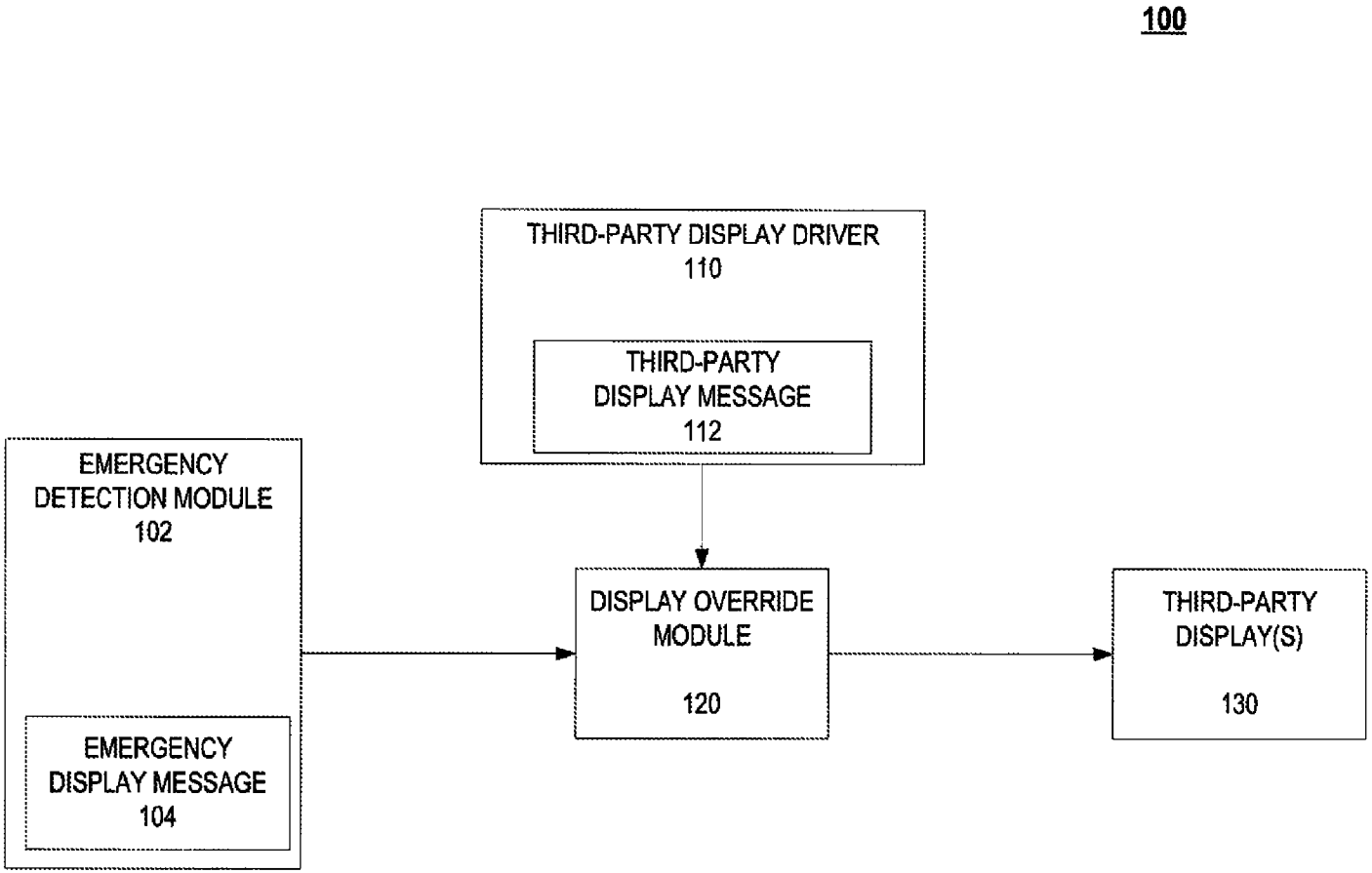
FIG. 1 illustrates a system for providing emergency override of informational displays in accordance with one or more embodiments.

FIG. 1 illustrates a block diagram of a system 100 in accordance with one or more embodiments. System 100 may include an emergency detection module 102. Emergency detection module 102 may monitor for emergency situations, such as fires, elevated carbon monoxide, toxins, dangerous weather conditions, or human-caused emergencies such as criminal activity. Emergency detection module 102 may monitor for emergencies directly and/or may receive emergency alerts from other sources, such as police departments, campus security, weather services, etc. Emergency detection module 102 may have multiple methods of alerting about an emergency condition, such as, but not limited to, sirens, strobe lights, etc.

When an emergency condition is detected or received, emergency detection module 102 generates an emergency display message 104. Emergency display message 104 may be, for example, a text message, an audio message, a video message, a still image, a combination thereof, etc. In an embodiment, generating emergency display message 104 may include retrieving the message from a computer-readable storage medium according to the type of emergency. Generating emergency display message 104 may also include receiving a manually entered message. System 100 includes a third-party display driver 110 that transmits third-party display messages 112 for display on one or more third-party display(s) 130. Third-party display driver 110 may be a computer or computer system, or transmitting system. System 100 includes a display override module 120 which is coupled to, or in communication with, third-party displays 130, emergency detection module 102 and third-party display driver 110. Display override module 120 is configured to change the source of information to be displayed from display driver 110 to emergency detection module 102 when an emergency condition is detected as described in more detail below.

Figure 2:
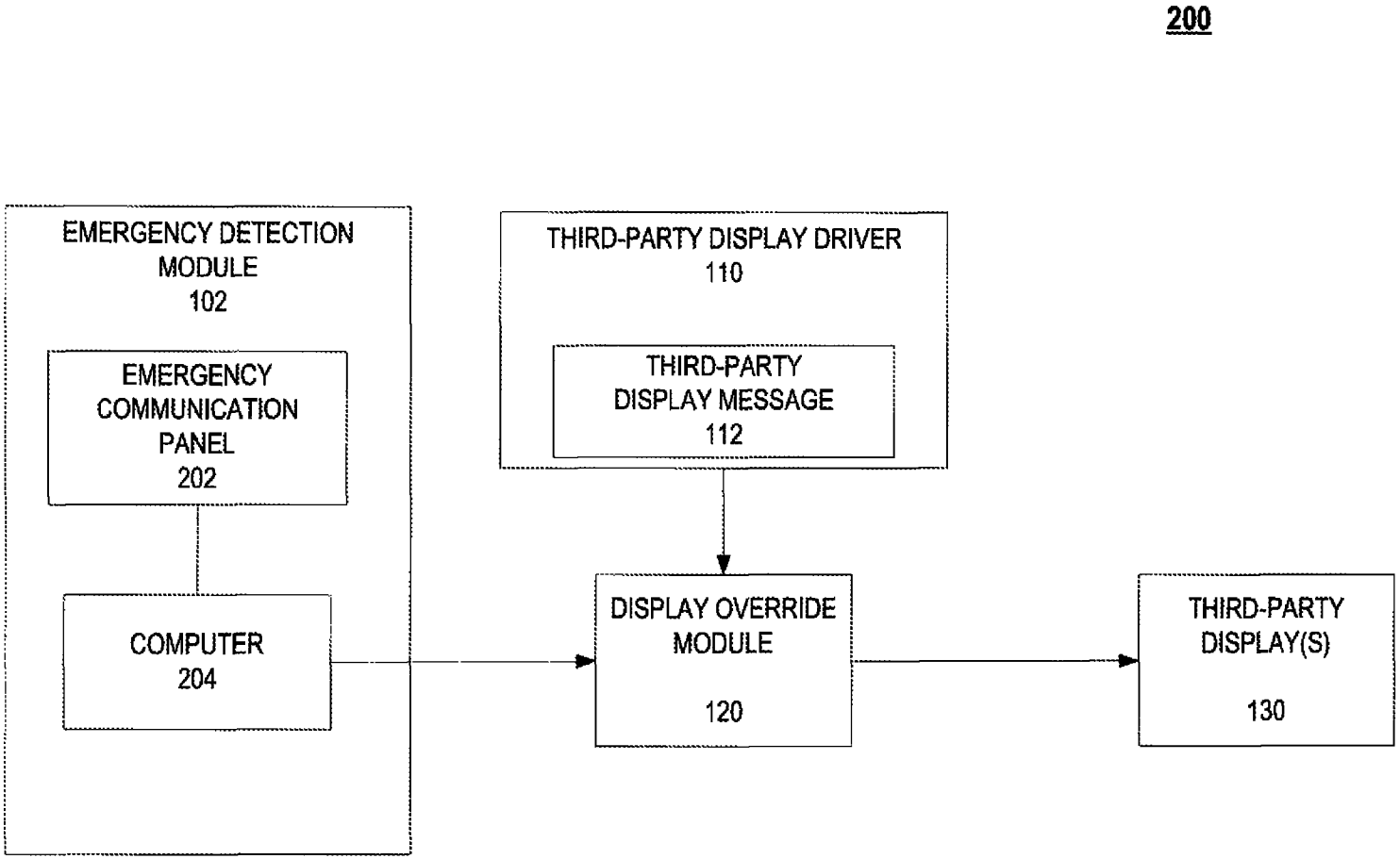
FIG. 2 illustrates a system for providing emergency override of informational displays in accordance with one or more embodiments.

FIG. 2 illustrates a block diagram of a system 200 in accordance with one or more embodiments. System 200 may be an embodiment of system 100. In particular, FIG. 2 illustrates an embodiment of emergency detection module 102 that includes an emergency communication panel 202 and a computer 204. Emergency communication panel 202 may be a fire alarm or emergency communication system, such as, but not limited to, SIMPLEX® brand fire alarm control panels.

Computer 204 may be a stand-alone computer or may be integrated as a component of emergency communication panel 202. If stand-alone, computer 204 is coupled wired or wirelessly to emergency communication panel 202. Computer 204 (and/or third-party display driver 110) is generally known and includes various common computing elements, such as one or more processors, co-processors, memory units, chipsets, controllers, peripherals, interfaces, oscillators, timing devices, video cards, audio cards, multimedia input/output (I/O) components, and so forth. The embodiments of computer 204 and display driver 110, however, are not limited to this implementation.

Emergency communication panel 202 communicates information about a detected emergency condition to computer 204. For example, emergency communication panel 202 may send a code that corresponds to a type of emergency to computer 204. Computer 204 may use the code to select which emergency display message 104 to display. Emergency communication panel 202 transmits the emergency display message 104 (shown in FIG. 1) to computer 204. Computer 204 transmits the emergency display message 104 to display override module 120 wirelessly or via a wired connection. Display override module 120 transmits emergency display message 104 to third-party display(s) 130.

Figure 3:
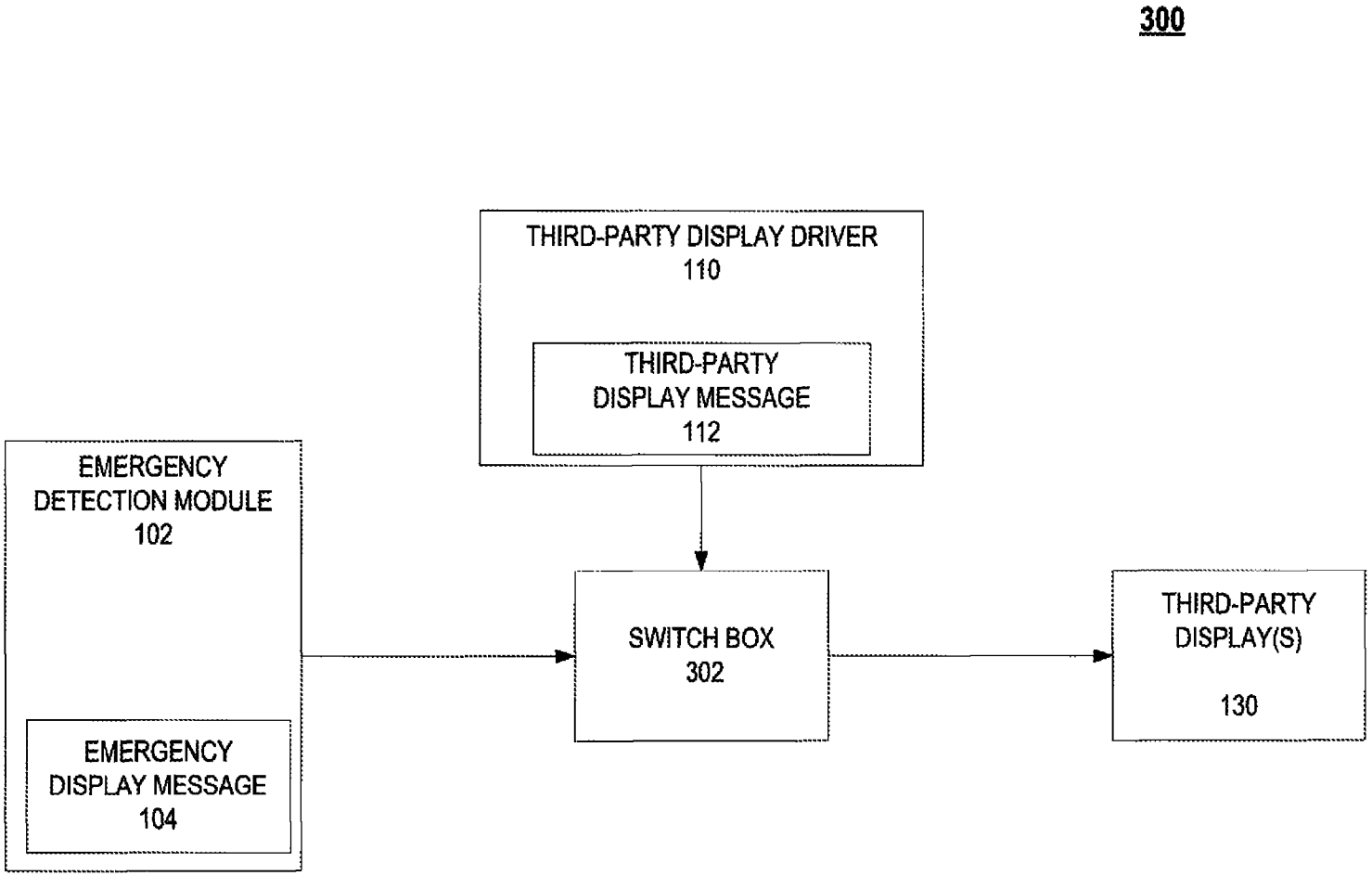
FIG. 3 illustrates a system for providing emergency override of informational displays in accordance with one or more embodiments.

FIG. 3 illustrates a block diagram of a system 300 in accordance with one or more embodiments. System 300 may be an embodiment of system 100 and/or system 200. In system 300, display override module 120 may be a switch box 302. Switch box 302 may be, for example, an electronic switch, an electromechanically controlled switch such as a relay), etc., having at least two ports. In an embodiment, emergency detection module 102 operates display driver software that controls switch box 302. Emergency detection module 102 may change switch box 302 to receiving a display feed from emergency detection module 102, via the display driver software. Switch box 302 may then pass emergency display message 104 from emergency detection module 102 to third-party displays 130. When the emergency condition is finished, emergency detection module 102 may change the switch box 302 back to receiving third-party display message 112 from third-party display driver 110. In an embodiment, emergency detection module 102 may also monitor which port of switch box 302 is active. If the switch box 302 is unresponsive, then an alert or trouble signal may be generated to prompt repair.

Figure 4:
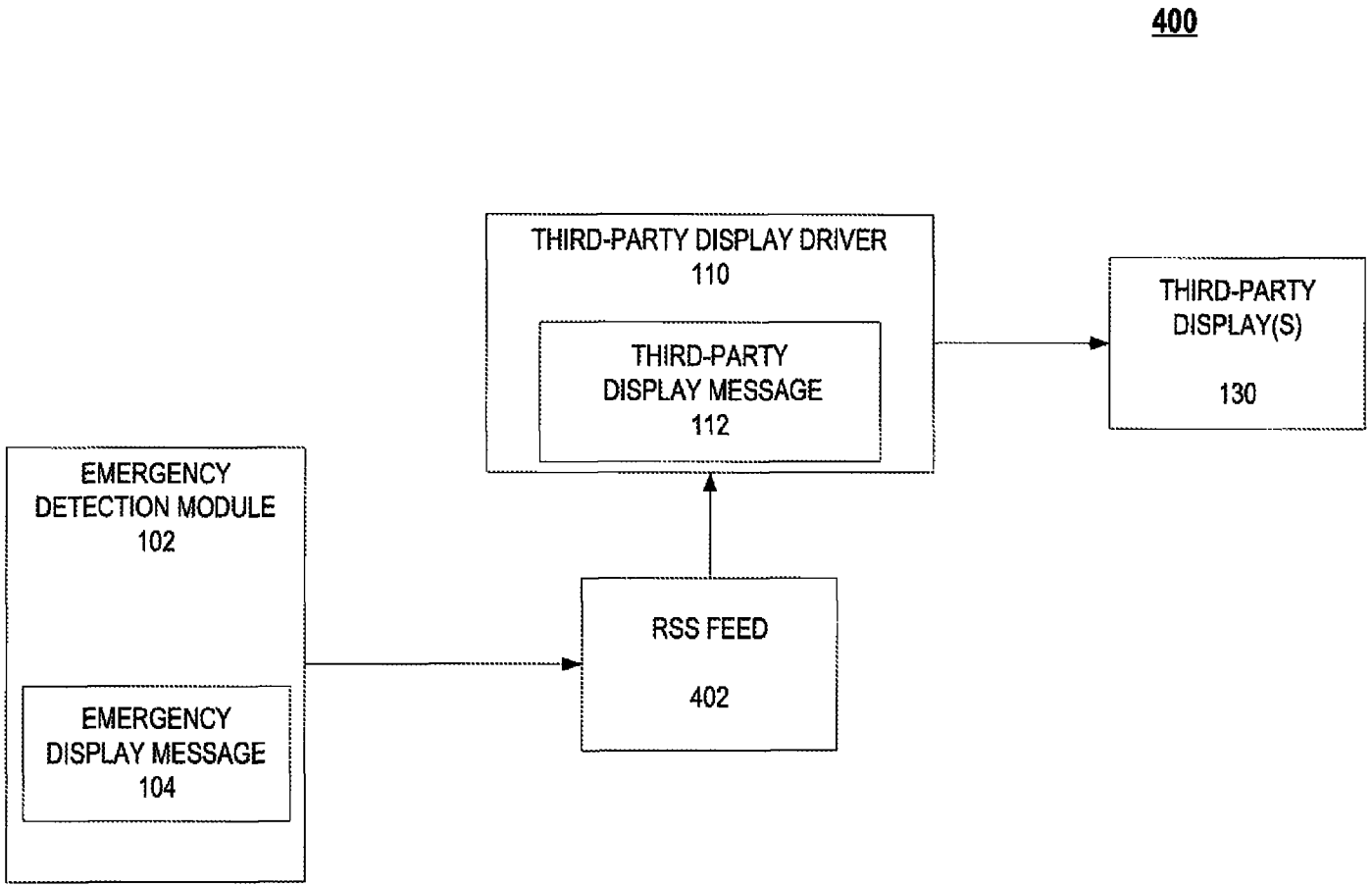
FIG. 4 illustrates a system for providing emergency override of informational displays in accordance with one or more embodiments.

FIG. 4 illustrates a block diagram of a system 400 in accordance with one or more embodiments. System 400 may be an embodiment of system 100 and/or system 200. In system 400, display override module 120 may be a really simple syndication (RSS) feed 402 hosted by a computer. In system 400, third-party display driver 110 may be subscribed to one or more RSS feeds, including RSS feed 402. Under non-emergency conditions, third-party display driver 110 transmits third-party display messages 112 obtained from other RSS feed subscriptions to third-party display(s) 130. When an emergency is detected at emergency detection module 102, module 102 generates the emergency display message 104 as an RSS feed 402. RSS feed 402 may override other RSS feeds at third-party display driver 110 and cause emergency display message 104 to be displayed on the third-party display(s) 130. In an embodiment, RSS feed 402 may prevent other RSS feeds from being displayed, for example, by having a higher priority or by delaying or preventing changes to a different RSS feed. In an embodiment such as the one shown in FIG. 2, computer 204 may generate and serve RSS feed 402. In addition, emergency detection module 102 may monitor whether RSS feed 402 has any subscribers. If no clients are subscribed or reading RSS feed 402, then an alert or trouble ticket may be generated to prompt repair.

Figure 5:
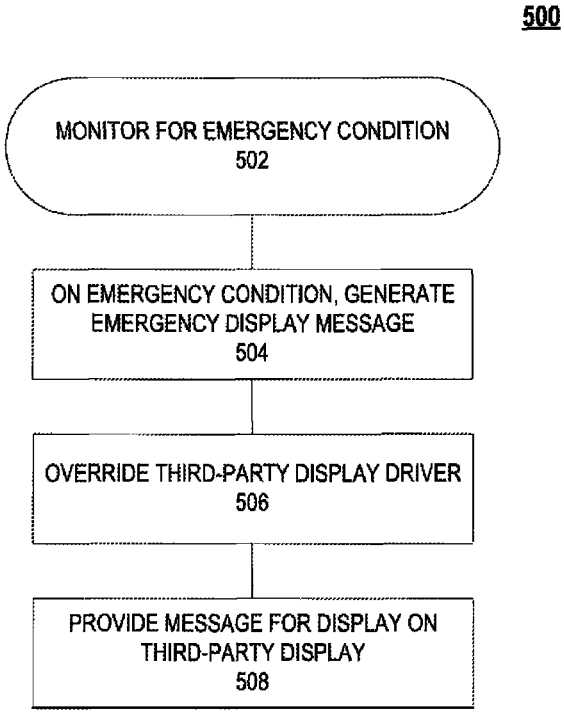
FIG. 5 illustrates a logic flow in accordance with one or more embodiments.

FIG. 5 illustrates a logic flow 500 in accordance with one or more embodiments. The logic flow 500 may be performed by various systems and/or devices and may be implemented as hardware, software, and/or any combination thereof, as desired for a given set of design parameters or performance constraints. For example, the logic flow 500 may be implemented by a logic device (e.g., processor) and/or logic (e.g., threading logic) comprising instructions, data, and/or code to be executed by a logic device. For purposes of illustration, and not limitation, the logic flow 500 is described with reference to FIG. 1. The embodiments are not limited in this context.

In the illustrated embodiment shown in FIG. 5, the logic flow 500 monitors for emergency conditions in block 502. For example, emergency detection module 102 may monitor for fires, elevated carbon monoxide, toxins, dangerous weather conditions, or human-caused emergencies such as criminal activity. Emergency detection module 102 may monitor for emergencies directly with sensors and/or may receive emergency alerts from other sources, such as police departments, campus security, weather services, etc.

Logic flow 500 may generate an emergency display message when an emergency condition is detected or received in block 504. For example, emergency detection module 102, emergency communication panel 202, or computer 204 may generate or retrieve emergency display message 104 according to the type of emergency detected or received. For example, in a fire emergency, emergency display message 104 may be "Evacuate building. Do not use elevators." In a dangerous weather condition such as a tornado or hurricane, emergency display message 104 may be "Dangerous weather. Shelter in place." Emergency display message 104 may take other forms in addition to text strings. For example, emergency display message 104 may also be a spoken message to be played through a speaker, an audio-visual message, etc.

Logic flow 500 may override the third-party display driver in block 506. For example, in an embodiment where display override module 120 comprises a switch box 302, emergency detection module 102 may cause switch box 302 to change the display driver source from a third-party display driver to emergency detection module 102. When the emergency condition is passed, emergency detection module 102 may cause switch box 302 to change the display driver source back to the third-party display driver. In an embodiment where display override module 120 comprises RSS feed 402, emergency detection module 102 may publish RSS feed 402 to override the display driver. When the emergency condition is passed, emergency detection module 102 may publish an "all clear" RSS feed, or may cease publishing RSS feed 402.

Logic flow 500 may provide a message for display on a third-party display in block 508. For example, emergency detection module 102 may provide emergency display message 104 directly to the third-party displays 130 via switch box 302. In another embodiment, emergency detection module 102 may publish RSS feed 402, to which third-party display driver 110 is subscribed. Third-party display driver 110 may then drive third-party displays 130 with RSS feed 402 and/or third-party display driver 110.

Numerous specific details have been set forth herein to provide a thorough understanding of the embodiments. It will be understood, however, that the embodiments may be practiced without these specific details. In other instances, well-known operations, components and circuits have not been described in detail so as not to obscure the embodiments. It can be appreciated that the specific structural and functional details are representative and do not necessarily limit the scope of the embodiments.

Various embodiments may comprise one or more elements. An element may comprise any structure arranged to perform certain operations. Each element may be implemented as hardware, software, or any combination thereof, as desired for a given set of design and/or performance constraints. Although an embodiment may be described with a limited number of elements in a certain topology by way of example, the embodiment may include more or less elements in alternate topologies as desired for a given implementation.

Any reference to "one embodiment" or "an embodiment" means that a particular feature, structure, or characteristic described in connection with the embodiment is included in at least one embodiment. The appearances of the phrase "in one embodiment" in the specification are not necessarily all referring to the same embodiment.

Although some embodiments may be illustrated and described as comprising exemplary functional components or modules performing various operations, it can be appreciated that such components or modules may be implemented by one or more hardware components, software components, and/or combination thereof. The functional components and/or modules may be implemented, for example, by logic (e.g., instructions, data, and/or code) to be executed by a logic device (e.g., processor). Such logic may be stored internally or externally to a logic device on one or more types of computer-readable storage media.

It also is to be appreciated that the described embodiments illustrate exemplary implementations, and that the functional components and/or modules may be implemented in various other ways which are consistent with the described embodiments. Furthermore, the operations performed by such components or modules may be combined and/or separated for a given implementation and may be performed by a greater number or fewer number of components or modules.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within registers and/or memories into other data similarly represented as physical quantities within the memories, registers or other such information storage, transmission or display devices.

It is worthy to note that some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other. With respect to software elements, for example, the term "coupled" may refer to interfaces, message interfaces, API, exchanging messages, and so forth.

Some of the figures may include a flow diagram. Although such figures may include a particular logic flow, it can be appreciated that the logic flow merely provides an exemplary implementation of the general functionality. Further, the logic flow does not necessarily have to be executed in the order presented unless otherwise indicated. In addition, the logic flow may be implemented by a hardware element, a software element executed by a processor, or any combination thereof.

While certain features of the embodiments have been illustrated as described above, many modifications, substitutions, changes and equivalents will now occur to those skilled in the art. It is therefore to be understood that the appended claims are intended to cover all such modifications and changes as fall within the true spirit of the embodiments.

The invention claimed is:

1. A system comprising:

an emergency detection module comprising:

an emergency communication panel configured to monitor for and detect an emergency condition; and a computer coupled to the emergency communication panel and configured to receive a code from the emergency communication panel that corresponds to a detected emergency condition, the computer configured to use the code to select a corresponding emergency display message from a plurality of predetermined emergency display messages; and a display override module, coupled to a display driver, configured to receive the emergency display message from the emergency detection module, and cause the selected emergency display message to be displayed on a display.

2. The system of claim 1, wherein the display override module comprises:

a really simple syndication (RSS) feed generated by the computer in response to an emergency detected by the emergency communication panel, and wherein the display driver is subscribed to read the RSS feed and drive the display according to the RSS feed.

3. The system of claim 1, wherein the display override module comprises:

a switch coupled to the emergency detection module and the display driver, wherein the display override module switches a display source of the display from the display driver to the emergency detection module.

4. The system of claim 1, wherein the display override module comprises:

a really simple syndication (RSS) feed generated by the emergency detection module, and wherein the display driver is subscribed to read the RSS feed and drive the display according to the RSS feed.

5. The system of claim 1, wherein the emergency display message is one of: a text message, an audio message, a video message, or an image.

6. A computer-implemented method comprising:

detecting an emergency condition at an emergency communication panel of an emergency detection module;

the emergency communication panel transmitting a code corresponding to the detected emergency condition to a computer of the emergency detection module;

the computer using the code to select a corresponding emergency display message from a plurality of predetermined emergency display messages; and overriding a third-party display driver to display the selected emergency display message on a display.

7. The method of claim 6, wherein overriding the display driver comprises:

changing a switch box that is coupled to the display from receiving a display message from the display driver to receiving the emergency display message from the emergency detection module.

8. The method of claim 6, wherein overriding the display driver comprises:

subscribing the display driver to a really simple syndication (RSS) feed generated by the emergency detection module; and publishing the emergency display messages as the RSS feed.

9. The method of claim 8 further comprising monitoring, using the emergency detection module, whether the RSS feed has a subscriber.

10. The method of claim 9 further comprising generating an alert message if no subscriber of the RSS feed is detected during monitoring.

11. The method of claim 6, wherein detecting an emergency condition comprises at least one of:

detecting an emergency with a sensor coupled to the emergency detection module; and receiving a notification of an emergency condition from an outside source.

12. The method of claim 6, wherein the emergency display message comprises at least one of:

a text message, an audio message, a video message, and an image.

13. The method of claim 6, further comprising:

monitoring for an error condition that would prevent overriding the display driver; and generating an alert when an error condition occurs.

14. A computer-implemented method comprising:

detecting an emergency condition at an emergency communication panel of an emergency detection module;

the emergency communication panel transmitting a code corresponding to the detected emergency condition to a computer of the emergency detection module;

the computer using the code to select a corresponding emergency display message from a plurality of predetermined emergency display messages; and overriding a display driver using a display override module coupled to the display driver, the display override module receiving the emergency display message from the emergency detection module and causing the selected emergency display message to be displayed on a display.

15. The method of claim 14, wherein overriding the display driver comprises:

changing a switch box that is coupled to the display from receiving a display message from the display driver to receiving the emergency display message from the emergency detection module.

16. The method of claim 14, wherein overriding the display driver comprises:

subscribing the display driver to a really simple syndication (RSS) feed generated by the emergency detection module; and publishing the emergency display messages as the RSS feed.

17. The method of claim 16, further comprising monitoring, using the emergency detection module, whether the RSS feed has a subscriber.

18. The method of claim 17, further comprising generating an alert message if no subscriber of the RSS feed is detected during monitoring.

19. The method of claim 14, wherein detecting an emergency condition comprises at least one of:

detecting an emergency with a sensor coupled to the emergency detection module; and receiving a notification of an emergency condition from an outside source.

20. The method of claim 14, wherein the emergency display message comprises at least one of a text message, an audio message, a video message, and an image.

21. The method of claim 14, further comprising:

monitoring for an error condition that would prevent overriding the display driver; and generating an alert when an error condition occurs.

* * * * *